US007640602B2

(12) United States Patent
Chetelat et al.

(10) Patent No.: US 7,640,602 B2
(45) Date of Patent: Jan. 5, 2010

(54) ASSEMBLED ANTI-CREEP WAIST-CLOTHING STAY DEVICE AND METHOD OF REINFORCING CROTCH-ADJACENT INNER-SEAM AREAS

(75) Inventors: Catherine Chetelat, Baltimore, MD (US); Michael Chetelat, Perry Hall, MD (US)

(73) Assignee: ProductMasters, Inc., Baltimore, MD (US)

( * ) Notice: Subject to any disclaimer, the term of this patent is extended or adjusted under 35 U.S.C. 154(b) by 594 days.

(21) Appl. No.: 11/096,666

(22) Filed: Apr. 1, 2005

(65) Prior Publication Data

US 2006/0218699 A1 Oct. 5, 2006

(51) Int. Cl.
*A41D 27/00* (2006.01)

(52) U.S. Cl. ..... 2/256; 2/255; 2/228; 2/401

(58) Field of Classification Search ..... 2/255, 2/256, 258, 231, 23, 78.1, 22, 401, 260.1, 2/260; 223/27, 84; 450/106, 107, 112, 114, 450/143, 144

See application file for complete search history.

(56) References Cited

U.S. PATENT DOCUMENTS

| | | | | | |
|---|---|---|---|---|---|
| 251,735 | A | * | 1/1882 | Ross | 2/258 |
| 279,549 | A | | 6/1883 | Erlanger | |
| 538,337 | A | | 4/1895 | Ludwig | |
| 807,098 | A | | 12/1905 | Valentine | |
| 849,137 | A | | 4/1907 | Kops | |
| 1,337,901 | A | | 4/1920 | Godward | |
| 1,340,276 | A | | 5/1920 | Koehne | |
| 1,845,809 | A | | 2/1932 | Panes | |
| 1,974,162 | A | | 9/1934 | Schlaepfer | |
| 2,056,742 | A | | 10/1936 | Sarachek | |
| 2,595,112 | A | * | 4/1952 | Story | 206/460 |
| 2,595,133 | A | * | 4/1952 | Golden | 2/260.1 |
| 2,597,179 | A | | 5/1952 | Pohlod | |
| 2,599,636 | A | * | 6/1952 | Hull | 2/132 |
| 2,692,389 | A | * | 10/1954 | Lamkin et. al. | 2/260 |
| 2,702,907 | A | | 3/1955 | Berniker et al. | |
| 2,773,265 | A | | 12/1956 | Dick | |
| 2,843,852 | A | * | 7/1958 | Stone, III | 2/401 |
| 2,864,376 | A | * | 12/1958 | Seperack | 450/100 |
| 2,895,482 | A | | 7/1959 | Marino | |

(Continued)

FOREIGN PATENT DOCUMENTS

| | | |
|---|---|---|
| EP | 0 237 657 | 3/1986 |

(Continued)

*Primary Examiner*—Katherine Moran
*Assistant Examiner*—Richale L. Quinn
(74) *Attorney, Agent, or Firm*—Jansson Shupe & Munger Ltd.

(57) ABSTRACT

A pre-assembled anti-creep waist-clothing stay device including a patch having front and back surfaces and sized for application to a crotch-adjacent inner-seam area of the waist-clothing and a stay strip affixed to the back surface of the patch, the stay strip being positioned and sized such that the patch extends beyond edges of the stay strip. In key embodiments, the patch includes a heat-activated adhesive such that, when the patch is applied to the waist-clothing with iron-on heat and pressure, the patch adheres at its back surface to the waist-clothing, thereby securing the stay strip in position to prevent the waist-clothing from riding up and bunching in the crotch area.

16 Claims, 3 Drawing Sheets

U.S. PATENT DOCUMENTS

| | | | | | |
|---|---|---|---|---|---|
| 3,032,775 | A | * | 5/1962 | Robitaille et al. | 2/255 |
| 3,037,211 | A | * | 6/1962 | Bohm | 2/256 |
| 3,115,642 | A | | 12/1963 | Haring | |
| 3,126,007 | A | | 3/1964 | Jonas | |
| 3,357,028 | A | * | 12/1967 | Laniado | 2/256 |
| 3,478,748 | A | | 11/1969 | Bjorn-Larsen | |
| 3,508,550 | A | * | 4/1970 | Vollrath | 604/394 |
| 3,637,230 | A | | 1/1972 | Poik | |
| 4,647,492 | A | * | 3/1987 | Grant et al. | 428/198 |
| 4,989,273 | A | | 2/1991 | Cromartie | |
| 6,076,193 | A | * | 6/2000 | Hood | 2/227 |
| 6,089,422 | A | * | 7/2000 | Gibson | 223/84 |
| 6,446,268 | B1 | | 9/2002 | Lazarian | |

FOREIGN PATENT DOCUMENTS

| | | |
|---|---|---|
| JP | 4-18616 | 2/1992 |
| JP | 11-131311 | 5/1999 |
| JP | 2001-262401 | 9/2001 |
| WO | WO02/085641 | 10/2002 |

* cited by examiner

ASSEMBLED ANTI-CREEP WAIST-CLOTHING STAY DEVICE AND METHOD OF REINFORCING CROTCH-ADJACENT INNER-SEAM AREAS

FIELD OF THE INVENTION

The present invention relates to the field of stays for garments and, more particularly, to clothing stays for preventing material of the leg-portions from riding up and bunching in the crotch area of the garment.

BACKGROUND OF THE INVENTION

Waist-garments, such as shorts, swimsuits, even full-length trousers and various other similar garments, often share a particular problem. The material of the leg-portions along the inner-seams tends to ride up and bunch in the crotch area.

U.S. Pat. No. 6,076,193 (Hood) describes a clothing arrangement incorporating "a stay member secured to the lateral inner area of the pant leg such that the stay member substantially prevents the interior lateral lower edge from moving towards the crotch are when the pant leg is worn by a person." While the Hood invention represents an important advance which overcomes the problem of material riding up and bunching in the crotch area of waist-garments, as described above, significant improvements are need to make such advantages easily available for people experiencing such problems.

U.S. Pat. No. 2,692,389 (Lamkin) describes a garment stay secured to a garment without sewing it in place. More particularly, the stay is bonded to the garment by a separate patch that, upon application to the garment, traps the stay in place. The patch is bonded to the garment with the use of thermo-setting resin and application of heat and pressure. Lamkin's method is complex and difficult to perform.

Known garment stays have a variety of additional problems and disadvantages. In some cases, stays may be positioned in locations on garments which cause skin irritation to the wearers. In other cases, sharp ends of the stays may project through cloth, causing a variety of problems, including causing wear at particular points of garment material. Furthermore, a variety of ways providing stays on garments can be problematic. Furthermore, it would be desirable to have garment stay devices overcoming a variety of problems, including those described above.

OBJECTS OF THE INVENTION

It is an object of the invention to provide an improved anti-creep waist-clothing stay overcoming some of the problems and shortcomings of the prior art, including those referred to above.

Another object of the invention is to provide an improved anti-creep waist-clothing stay preventing the garment leg-portions from riding up and bunching in the crotch area.

Another object of the invention is to provide an improved anti-creep waist-clothing stay designed to deter the wearier's skin irritation by the stay.

Still another object of the invention is to provide an improved anti-creep waist-clothing stay designed for an attachment to the garment without special skills or equipment.

Yet another object of the invention is to provide a pre-assembled anti-creep waist-clothing stay facilitating quick and easy attachment of the stay to the garment.

Another object of the invention is to provide an improved anti-creep waist-clothing stay having ends with smooth finishing inhibiting their poking or tearing through the fabric.

How these and other objects are accomplished will become apparent from the following descriptions and the drawings.

SUMMARY OF THE INVENTION

This invention, which will be described in detail below, is an improvement in anti-creep stays for waist-clothing of the type having leg-portions.

The present invention provides a pre-assembled anti-creep waist-clothing stay device and method of reinforcing crotch-adjacent inner-seam areas overcoming the problems described above. The present invention permits easy and quick waist-clothing retrofitting process without any special skills or equipment. An average person can attach the inventive pre-assembled stay device to the waist-clothing by ironing the stay devices on the crotch adjacent inner-seam areas of the waist-clothing to prevent the waist-clothing material from riding up and bunching in the crotch area. Furthermore, the stay device of the present invention incorporates a boning material having smooth finishing on its ends which eliminates a common disadvantage of known garment stays such as tearing through the material.

The inventive pre-assembled anti-creep waist-clothing stay device includes a patch having front and back surfaces and sized for application to a crotch-adjacent inner-seam area of the waist-clothing, and a stay strip affixed to the back surface of the patch. The stay strip being positioned and sized such that the patch extends beyond edges of the stay strip.

In highly preferred embodiments of this invention the stay strip is affixed to the patch by an adhesive.

The patch preferably includes a heat-activated adhesive such that, when the patch is applied to the waist-clothing with iron-on heat and pressure, the patch adheres at its back surface to the waist-clothing, thereby securing the stay strip in position to prevent the waist-clothing from riding up and bunching in the crotch area.

In certain preferred embodiments, the stay strip has an affixed side and a free side. The free side is coated with a contact adhesive for pre-application positioning of the stay device on the waist-clothing. In such embodiments, the contact adhesive on the free side has a peel-off cover thereon to protect the adhesive prior to use.

The stay strip may be of any size but preferably no less than about 2 inches long and no more than about one-half inch wide. The stay strip is preferably made of polyester or other polymeric boning materials.

In certain highly preferred embodiments the stay strip is formed by a plurality of generally parallel interconnected monofilaments each having an end-point. In such embodiments the stay strip has convex curved ends with a smooth finishing formed by the end-points being melted together, thus, eliminating roughness and minimizing tearing of the stay strip through the patch or the waist-clothing. The patch has outer edges which are substantially parallel to the corresponding edges of the stay strip such that iron-on interconnection of the stay device to the waist-clothing can be secure all about the stay strip.

Another important aspect of this invention involves a method of reinforcing a waist-clothing of the type having two leg-portions with inner-seams forming a crotch to prevent cloth riding up and bunching in the crotch area. The inventive method includes: providing a pre-assembled anti-creep waist-clothing stay device including a patch having front and back surfaces and sized for application to a crotch-adjacent inner-seam area of the waist-clothing; and a stay strip affixed to the back surface, the strip being positioned and sized such that the patch extends beyond edges of the strip, the patch includes a heat-activated adhesive; placing the stay device on a crotch-adjacent inner-seam area of the waist-clothing with the back of the patch facing the leg-portion; and pressing hot iron on the front surface of the patch for iron-on activation of the heat-reactive adhesive such that the patch adheres at its back surface to the waist-clothing, thereby securing the stay strip in a position to prevent the waist-clothing from riding up and bunching in the crotch area.

In certain preferred examples of the inventive method, the free side of the stay strip is coated with a contact adhesive covered with a protective peel-off film. In such preferred examples, the method includes the further step of peeling the protective film off the free side of the stay strip prior to placing the stay device on the leg-portion. Whereby the contact adhesive holds the stay device in desired position prior to pressing the iron and supports the iron-on attachment of the stay device to the waist-clothing.

The present invention further provides an anti-creep waist-clothing of the type having two leg-portions sewn together forming a crotch with each leg-portion having an inner-seam extending from the crotch down along the leg-portion. The pre-assembled anti-creep stay device is adhered to a crotch-adjacent inner-seam area of the waist-clothing. Thus, the anti-creep waist-clothing is free of cloth riding up and bunching in the crotch area.

The term "waist-clothing," as used herein, refers to garments worn below a person's waist-line and having two leg-portions. Such garments include shorts, skorts, full-length trousers, swimsuits and other similar clothing articles.

DETAILED DESCRIPTION OF PREFERRED EMBODIMENTS

Figure 1:
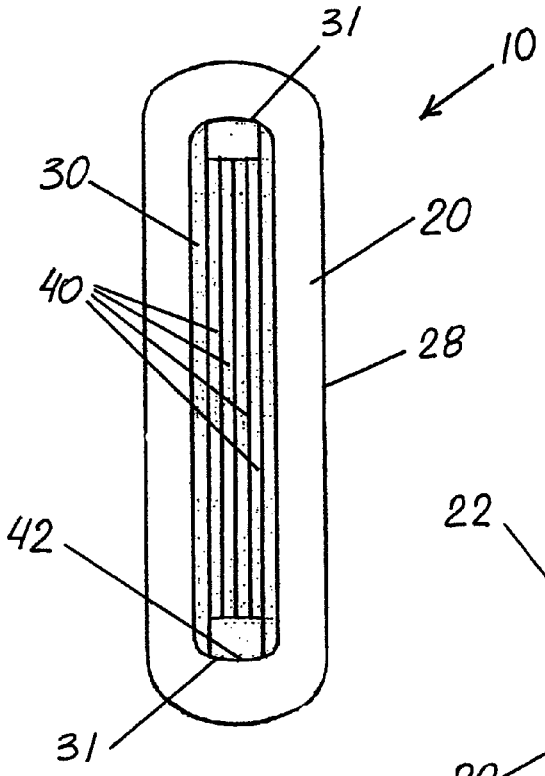
FIG. 1 is a back view of a pre-assembled anti-creep waist-clothing stay device.
Figure 3A:
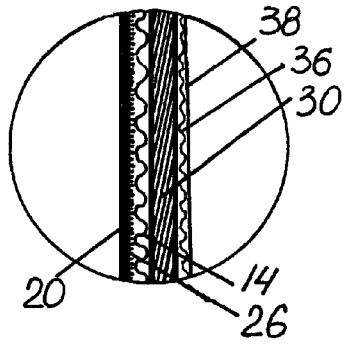
FIG. 3A is a magnified fragmentary view of the portion indicated in FIG. 3.

Referring to the figures, a pre-assembled anti-creep waist-clothing stay device 10 includes a patch 20 having front surface 22 and back surface 24, and a stay strip 30 affixed to back surface 24, stay strip 30 being positioned and sized such that patch 20 extends beyond edges of strip 30. As schematically shown on FIGS. 2 and 3, stay strip 30 is affixed to patch 20 by an adhesive 14.

Figure 4:
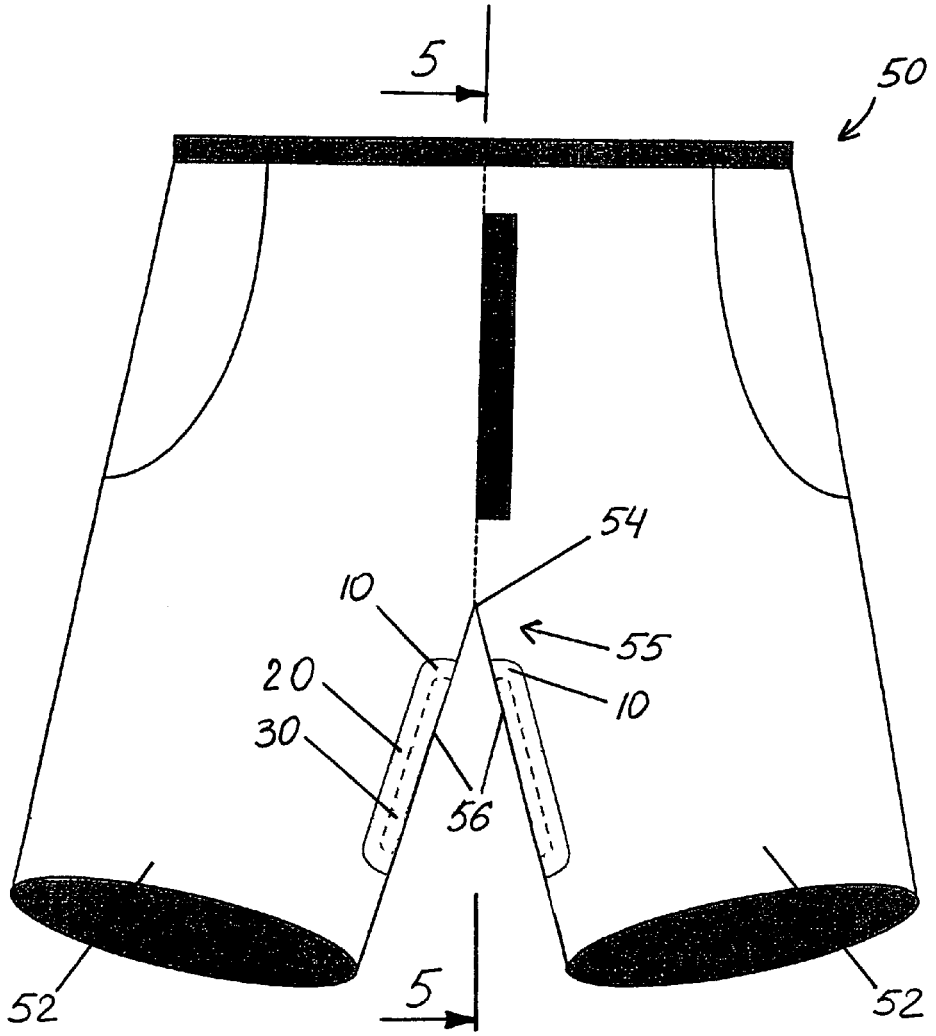
FIG. 4 is a perspective view of a waist-clothing with two iron-on stay devices of FIG. 1 installed thereon.
Figure 5:
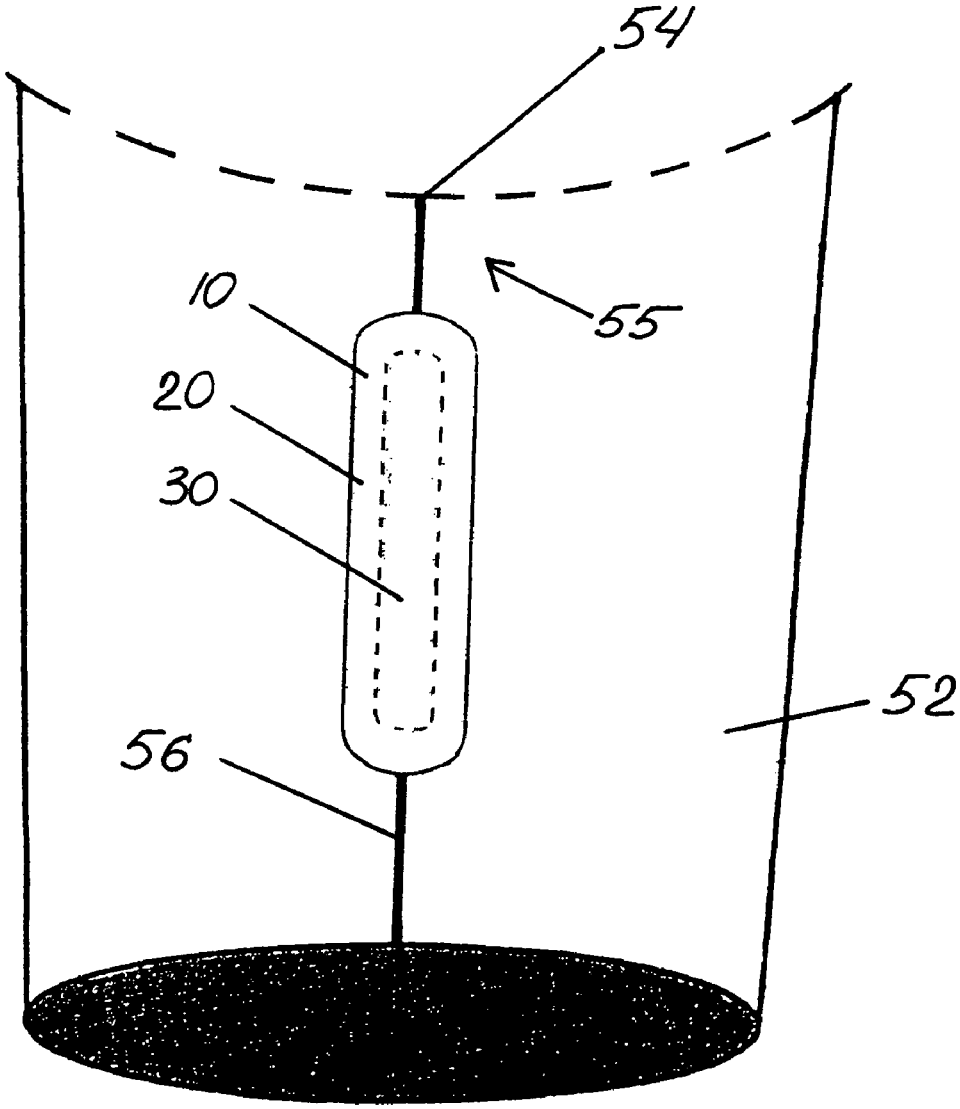
FIG. 5 is a perspective sectional view taken along a portion of section 5-5 as indicated on FIG. 4.

FIG. 4 illustrates an anti-creep waist-clothing 50 having two leg-portions 52 sewn together forming a crotch 54. Each leg-portion 52 has an inner-seam 56 extending from crotch 54 down along leg-portion 52. As best shown on FIG. 5, pre-assembled anti-creep stay device 10 is adhered to a crotch-adjacent inner-seam area 50 of waist-clothing 50. Thus, anti-creep waist-clothing 50 is free of cloth riding up and bunching in crotch area 55.

Figure 2:
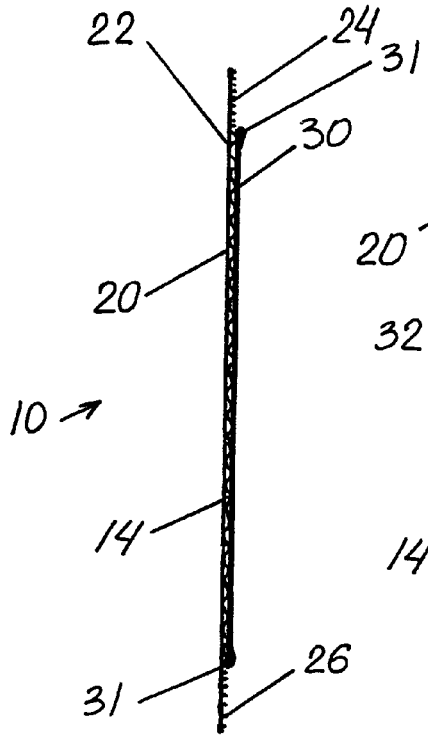
FIG. 2 is a side view of the stay device of FIG. 1.
Figure 3:
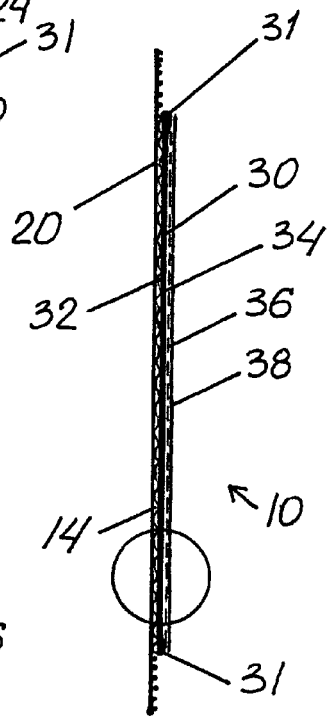
FIG. 3 is a side view of another embodiment like that of FIG. 2, but with an added feature.

FIGS. 2 and 3 further schematically illustrate patch 20 having a heat-activated adhesive 26 on such that, when patch 20 is applied to waist-clothing 50 with iron-on heat and pressure, patch 20 adheres at its back surface 24 to waist-clothing 50, thereby securing stay strip 30 in position to prevent waist-clothing from riding up and bunching in a crotch area 55.

Stay strip 30 has an affixed side 32 and a free side 34. FIG. 3 further schematically illustrates the certain preferred embodiment of stay device 10 having free side 34 coated with a contact adhesive 36 for pre-application positioning of stay device 10 on waist-clothing 50. Contact adhesive 36 on free side 34 has a peel-off cover 38 to protect adhesive 36 prior to use.

As shown on FIG. 1 stay strip 30 is formed by a plurality of generally parallel interconnected monofilaments 40 each having an end-point 42. Stay strip 30 has convex curved ends 31 with a smooth finishing formed by the end-points 42 being melted together, thus, eliminating roughness and minimizing tearing of stay strip 30 through patch 20 or waist-clothing 50. Patch 20 has outer edges 28 which are substantially parallel to the corresponding edges 33 of stay strip 30 such that iron-on interconnection of stay device 10 to waist-clothing 50 can be secure all about stay strip 30.

While the principles of the invention have been shown and described in connection with specific embodiments, it is to be understood that such embodiments are by way of example and are not limiting.

The invention claimed is:

1. An assembled anti-creep waist-clothing stay device comprising:

a stay strip having a free side coated with a first adhesive which is a contact adhesive for pre-application positioning of the stay device on the waist-clothing, the contact adhesive on the free side having a peel-off cover thereon to protect the adhesive prior to use; and a patch having front and back surfaces and being sized for application to a crotch-adjacent inner-seam area of the waist-clothing, the stay strip being affixed to the back surface and being sized and positioned thereon such that the patch extends beyond the edges of the stay strip, the back surface including a second adhesive thereon which is a heat-activated adhesive such that, when the patch is applied to the waist-clothing with iron-on heat and pressure, the patch adheres at its back surface to the waist-clothing, thereby to secure the stay strip in position to prevent the waist-clothing from riding up and bunching in the crotch area.

2. The assembled anti-creep waist-clothing stay device of claim 1 wherein the stay strip is affixed to the patch by an adhesive.

3. The assembled anti-creep waist-clothing stay device of claim 1 wherein:

the stay strip is formed by a plurality of generally parallel interconnected monofilaments having end-points integral with one another and together forming smooth convex curved stay-strip ends; and the patch has outer edges which are substantially parallel to the corresponding edges of the stay strip such that iron-on interconnection of the stay device to the waist-clothing can be secure all about the stay strip.

4. The assembled anti-creep waist-clothing stay device of claim 1 wherein the width of the stay strip is no more than about one-half inch.

5. The assembled anti-creep waist-clothing stay device of claim 4 wherein the length of the stay strip is no less than about 2 inches.

6. An assembled anti-creep waist-clothing stay device comprising:

a stay strip formed by a plurality of generally parallel interconnected monofilaments having end-points melted together into a single piece forming smooth convex curved stay-strip ends; and a patch having front and back surfaces and being sized for application to a crotch-adjacent inner-seam area of the waist-clothing, the stay strip being affixed to the back surface and being sized and positioned thereon such that the patch extends beyond edges of the stay strip, the patch having outer edges which are substantially parallel to the corresponding edges of the stay strip, the patch including a heat-activated adhesive such that, when the patch is applied to the waist-clothing with iron-on heat and pressure, the patch adheres at its back surface to the waist-clothing, thereby securing the stay device to the waist-clothing all about the stay strip to prevent the waist-clothing from riding up and bunching in the crotch area.

7. A method of reinforcing a waist-clothing to prevent cloth riding up and bunching in the crotch area, the waist-clothing being of the type having two leg-portions with inner-seams forming a crotch, the improvement comprising:

providing an assembled anti-creep waist-clothing stay device including (a) a patch having front and back surfaces and sized for patch application to a crotch-adjacent inner-seam area of the waist-clothing, the patch including a heat-activated adhesive and (b) a stay strip affixed to the back surface, the stay strip being formed by a plurality of generally parallel interconnected monofilaments having end-points melted together into a single piece forming smooth convex curved stay-strip ends, the patch having outer edges which are substantially parallel to the corresponding edges of the stay strip which is being positioned and sized such that the patch extends beyond edges of the strip;

placing the stay device on a crotch-adjacent inner-seam area of the waist-clothing with the back of the patch facing the leg-portion; and pressing a hot iron on the front surface of the patch for iron-on activation of the heat-reactive adhesive such that the patch adheres at its back surface to the waist-clothing, thereby securing the stay device to the waist-clothing in a position all about the stay strip to prevent the waist-clothing from riding up and bunching in the crotch area.

8. The method of claim 7 wherein the width of the stay strip is no more than about one-half inch.

9. The method of claim 8 wherein the length of the stay strip is no less than about 2 inches.

10. A method of reinforcing a waist-clothing to prevent cloth riding up and bunching in the crotch area, the waist-clothing being of the type having two leg-portions wit inner-seams forming a crotch, the improvement comprising:

providing an assembled anti-creep waist-clothing stay device including (a) a stay strip having a free side coated with a first adhesive which is a contact adhesive covered with a protective peel-off film and (b) a patch having front and back surfaces and being sized for application to a crotch-adjacent inner-seam area of the waist-clothing, the stay strip being affixed to the back surface and being sized and positioned thereon such that the patch extends beyond the edges of the stay strip, the back surface including a second adhesive thereon which is a heat-activated adhesive;

peeling the protective film off the free side of the stay strip;

placing the stay device on a crotch-adjacent inner-seam area of the waist-clothing with the back of the patch facing the leg-portion, the contact adhesive holding the stay device in desired position prior to pressing with a hot iron; and pressing the hot iron on the front surface of the patch for iron-on activation of the heat-reactive adhesive such that the patch adheres at its back surface to the waist-clothing, thereby securing the stay strip in a position to prevent the waist-clothing from riding up and bunching in the crotch area.

11. The method of claim 10 wherein the strip is affixed to the patch by an adhesive.

12. The method of claim 10 wherein:

the stay strip is formed by a plurality of generally parallel interconnected monofilaments having end-points integral with one another and together forming smooth convex curved stay-strip ends; and the patch has outer edges which are substantially parallel to the corresponding edges of the stay strip such that iron-on interconnection of the stay device to the waist-clothing can be secure all about the stay strip.

13. The method of claim 12 wherein the width of the stay strip is no more than about one-half inch.

14. The method of claim 13 wherein the length of the stay strip is no less than about 2 inches.

15. An anti-creep waist-clothing comprising:

a waist-clothing having two leg-portions sewn together forming a crotch, each leg-portion includes an inner-seam extending from the crotch down along the leg-portion; and an assembled anti-creep stay device adhered to a crotch-adjacent inner-seam area of the waist-clothing, said assembled stay device including (a) a patch having a back and front surfaces and a heat-activated adhesive and (b) a stay strip affixed to the patch, the stay strip being formed by a plurality of generally parallel interconnected monofilaments having end-points melted together into a single piece forming smooth convex curved stay-strip ends, the patch having outer edges which are substantially parallel to the corresponding edges of the stay strip which is affixed to the patch such that, when the patch is applied to the waist-clothing with iron-on heat and pressure, the patch adheres at its back surface to the waist-clothing, thereby securing the stay device to the waist-clothing in position all about the stay strip, whereby the waist-clothing is free of cloth riding up and bunching in the crotch area.

16. An assembled stay device for garments comprising:

a stay strip having a free side coated with a first adhesive which is a contact adhesive for pre-application positioning of the stay device on the garment, the contact adhesive on the free side having a peel-off cover thereon to protect the adhesive prior to use; and a patch having front and back surfaces and being sized for application to the garment, the stay strip being affixed to the back surface and being sized and positioned thereon such that the patch extends beyond the edges of the stay strip, the back surface including a second adhesive thereon which is a heat-activated adhesive such that, when the patch is applied to the garment with iron-on heat and pressure, the patch adheres at its back surface to the garment, thereby to secure the stay strip in position on the garment.

* * * * *